US009922482B2

(12) United States Patent
Ingle et al.

(10) Patent No.: US 9,922,482 B2
(45) Date of Patent: Mar. 20, 2018

(54) DEVICE AND METHOD FOR EXTENDING RESTRICTION OF ACCESS TO OBJECTS AND SUBSTANCES

(71) Applicants: Michael Earl Ingle, Thousand Oaks, CA (US); Jennifer Lorraine Derkitt, Thousand Oaks, CA (US)

(72) Inventors: Michael Earl Ingle, Thousand Oaks, CA (US); Jennifer Lorraine Derkitt, Thousand Oaks, CA (US)

( * ) Notice: Subject to any disclaimer, the term of this patent is extended or adjusted under 35 U.S.C. 154(b) by 19 days.

(21) Appl. No.: 15/164,897

(22) Filed: May 26, 2016

(65) Prior Publication Data

US 2016/0267739 A1 Sep. 15, 2016

Related U.S. Application Data

(62) Division of application No. 14/216,116, filed on Mar. 17, 2014, now Pat. No. 9,418,497.

(60) Provisional application No. 61/786,534, filed on Mar. 15, 2013.

(51) Int. Cl.
*G07C 9/00* (2006.01)
*G07C 1/32* (2006.01)

(52) U.S. Cl.
CPC ..... *G07C 9/00896* (2013.01); *G07C 9/00912* (2013.01); *G07C 1/32* (2013.01); *G07C 9/00817* (2013.01); *G07C 2209/08* (2013.01)

(58) Field of Classification Search
None
See application file for complete search history.

(56) References Cited

U.S. PATENT DOCUMENTS

| | | | | |
|---|---|---|---|---|
| 186,369 | A | 1/1877 | Sargent | |
| 3,950,678 | A | 4/1976 | Brewer | |
| 4,853,854 | A | 8/1989 | Behar | |
| 4,875,351 | A | 10/1989 | Evans | |
| 5,129,536 | A | 7/1992 | Robinson | |
| 5,203,472 | A | 4/1993 | Levenbaum | |
| 5,387,903 | A | 2/1995 | Cutter | |
| 5,594,430 | A | 1/1997 | Cutter | |
| 5,774,059 | A | 6/1998 | Henry | |
| 5,908,301 | A | 6/1999 | Lutz | |
| 6,169,707 | B1 | 1/2001 | Newland | |
| 6,712,075 | B1 | 3/2004 | Garcia | |
| 6,825,753 | B2 | 11/2004 | Cardinale | |
| 7,728,711 | B2 | 6/2010 | Shoenfeld | |
| 7,768,378 | B2 | 8/2010 | Hill | |
| 2003/0051645 | A1 | 3/2003 | Rigatuso | |
| 2003/0090364 | A1 * | 5/2003 | Cardinale | E05B 43/005 340/5.54 |
| 2006/0237427 | A1 | 10/2006 | Logan | |

(Continued)

*Primary Examiner* — Albert K Wong

(57) ABSTRACT

A time-locking container to limit the compulsive overuse of objects and substances, such as but not limited to money, food, alcohol, and tobacco. The container locks until a future date and time of day set by the user. The unit displays the duration of locking, permits the user to cancel, and can require affirmative confirmation if locking exceeds a user-selected maximum duration. This feature prevents an accidental prolonged lockout. While the container is locked, the user can extend, but not shorten, the duration of locking. This feature permits the user, while experiencing guilt due to overindulgence, to further delay access without the temptation of an open door.

4 Claims, 9 Drawing Sheets

(56) References Cited

U.S. PATENT DOCUMENTS

| | | | | |
|---|---|---|---|---|
| 2007/0257773 | A1* | 11/2007 | Hill | E05B 17/2088 340/5.73 |
| 2014/0035721 | A1* | 2/2014 | Heppe | G07C 9/00912 340/5.54 |
| 2014/0117818 | A1* | 5/2014 | Dipaolo | A47F 3/002 312/139 |
| 2016/0379431 | A1* | 12/2016 | Borg | G07C 9/00706 340/5.28 |

* cited by examiner

601

| | | |
|---|---|---|
| WILLPOWER VAULT<br>KEY 1* FOR SETTINGS<br>OR 2* TO POWER OFF<br>NOW JUL 9'12 3:29P<br>602 | WILLPOWER VAULT<br>PRESS 3* FOR<br>ONE DAY QUICK LOCK<br>NOW JUL 9'12 3:29P<br>603 | WILLPOWER VAULT<br>PRESS 4* TO SKIP<br>NEXT OPEN TIME<br>NOW JUL 9'12 3:29P<br>604 |
| WILLPOWER VAULT<br>PRESS 5* TO START<br>COOLDOWN OPEN TIMER<br>NOW JUL 9'12 3:29P<br>605 | WILLPOWER VAULT<br>PRESS * TO SET NEXT<br>OPEN TIME AND LOCK<br>NOW JUL 9'12 3:29P<br>606 | WILLPOWER VAULT<br>KEY * TO LOCK UNTIL<br>TUE JUL 10'12 8:00P<br>NOW JUL 9'12 3:29P<br>607 |
| WILLPOWER VAULT<br>AUTO RELOCK TIME<br>TUE JUL 10'12 8:00P<br>NOW JUL 9'12 3:29P<br>608 | LOCK LESS THAN 1 DAY<br>WED SEP 19'12 1:38P<br>NOW SEP 19'12 12:30P<br>* DON'T LOCK # LOCK<br>609 | LOCKING FOR 10 DAYS<br>THU SEP 27'12 1:30P<br>NOW SEP 17'12 1:20P<br>* DON'T LOCK # LOCK<br>610 |
| ANY KEY TO ABORT<br>LOCKING IN 10 UNTIL<br>TUE JUL 10'12 8:00P<br>NOW JUL 9'12 3:29P<br>611 | WILLPOWER VAULT<br>VAULT LOCKED UNTIL<br>TUE JUL 10'12 8:00P<br>NOW JUL 9'12 3:29P<br>612 | WILLPOWER VAULT<br>KEYPAD SECURED<br>ENTER CODE AND #<br>NOW JUL 9'12 3:29P<br>613 |
| WILLPOWER VAULT<br>VAULT IS UNLOCKED<br>KEY IN CODE AND #<br>NOW JUL 9'12 3:29P<br>614 | WILLPOWER VAULT<br>INCORRECT CODE<br>PLEASE TRY AGAIN<br>NOW JUL 9'12 3:29P<br>615 | WILLPOWER VAULT<br>TURN DIAL CLOCKWISE<br>AND OPEN THE DOOR<br>NOW JUL 9'12 3:29P<br>616 |
| VAULT DOOR AJAR<br>KEY 1* FOR SETTINGS<br>OR 2* TO POWER OFF<br>NOW JUL 9'12 3:29P<br>617 | WILLPOWER VAULT<br>COOLDOWN TIMER<br>ACTIVATED<br>NOW JUL 9'12 3:29P<br>618 | WILLPOWER VAULT<br>COOLDOWN TIMER<br>CANCELLED<br>NOW JUL 9'12 3:29P<br>619 |
| WILLPOWER VAULT<br>COOLDOWN RELOCKING<br>PRESS * TO DELAY<br>NOW JUL 9'12 3:29P<br>620 | WILLPOWER VAULT<br>COOLDOWN OPEN TIME<br>MON JUL 9'12 4:29P<br>NOW JUL 9'12 3:36P<br>621 | WILLPOWER VAULT<br>COOLDOWN RELOCK TIME<br>MON JUL 9'12 5:29P<br>NOW JUL 9'12 4:29P<br>622 |
| WILLPOWER VAULT<br>NO COOLDOWN UNTIL<br>THU JUL 12'12 5:29P<br>NOW JUL 9'12 4:29P<br>623 | WILLPOWER VAULT<br>PRESS 5* TO CANCEL<br>COOLDOWN OPEN TIMER<br>NOW JUL 9'12 3:36P<br>624 | VERIFY NEW OPEN TIME<br>TUE JUL 10 2012<br>3:36 PM<br>PRESS # TO SAVE<br>625 |
| WILLPOWER VAULT<br>UNLOCKED SINCE<br>SUN JUL 8'12 5:29P<br>NOW JUL 9'12 4:29P<br>626 | | |

FIG. 6

DEVICE AND METHOD FOR EXTENDING RESTRICTION OF ACCESS TO OBJECTS AND SUBSTANCES

CROSS-REFERENCE TO RELATED APPLICATIONS

The present application is a divisional application of U.S. patent application Ser. No. 14/216,116, filed on Mar. 17, 2014, which is incorporated herein by reference in its entirety. U.S. patent application Ser. No. 14/216,116 claims priority from U.S. Provisional Patent Application No. 61/786,534 filed on Mar. 15, 2013, which is incorporated herein by reference in its entirety.

STATEMENT REGARDING FEDERALLY SPONSORED RESEARCH AND DEVELOPMENT

Not Applicable.

REFERENCE TO A SEQUENCE LISTING

Not Applicable.

BACKGROUND

1. Field

The application relates to locking containers, specifically to an improved time-locking container for self-control purposes, and to a method for its use.

2. Prior Art

U.S. Pat. No. 186,369 is the original patent for a mechanical time and combination lock, intended for bank vaults. This design is still commonly used today. U.S. Pat. No. 3,950,678 is an electronic time vault lock using digital logic. U.S. Pat. Nos. 4,875,351 and 5,387,903 are microcontroller-based time locks. All of these designs are optimized for bank vaults and/or store safes, and none have the features required for self-control applications.

U.S. Pat. No. 5,203,472 is an electronic timed cigarette dispenser intended to taper the user off tobacco addiction, and this patent cites older mechanical prior art in the field of restrictive smoking cessation devices. These are designed only for cigarettes, are too small to store alcohol or food, and are easily forced open.

U.S. Pat. No. 6,825,753 B2 is a novelty-type locking pyramid that can be set to open at a programmed date and time, provide a festive display of flashing lights and sound effects, and reveal contents such as a gift. The pyramid is not secure against forcible opening, does not display the duration of proposed locking, does not give the user an opportunity to cancel before locking, and does not require affirmative confirmation if locking exceeds a user-selected maximum duration. The open time cannot be extended while the pyramid is locked.

None of the prior art meets the need for a small, easy-to-use, secure container with specific features to enable self-control, as opposed to secure storage of money or valuables. Most existing time-locked safes are large, expensive, and made for commercial use. The clock display and input device are usually found on the inside of the door, meaning that the user cannot see the future unlocking time, or extend the unlocking time, while the safe is locked. These safes are usually complex to install, program, and operate, so that a locksmith is typically required. Such safes do not include features specifically designed for the self-control user.

SUMMARY

Many people have difficulty controlling behaviors, such as eating, drinking alcohol, smoking tobacco, or spending money. Most people with such difficulties express the desire to limit their future behavior, but are unable to do so.

One method of assisting such an individual in limiting an addictive or compulsive behavior is to deny his access to the substance or object used to indulge in the behavior.

The present device is an electronic precommitment device which allows a person to self-limit future access to one or more objects or substances until a predetermined date and time, or until a predetermined delay has elapsed since the user entered an access request. The device includes a variety of features intended specifically to promote self-control, which differentiate it from a traditional time-locking storage container or safe. Methods of use are also described.

In one embodiment of the device, the container can store a schedule of unlocking times, and can relock itself until the next scheduled unlocking time if a predetermined access period, for example one hour, is exceeded and opening has not been requested. This ensures that, if the user did not access the container's contents during the unlocked period, they are not left available indefinitely.

In another aspect of the device, called Extend While Locked, the user can manually set the unlocking time to a later date and time while the container is locked. The user cannot set the unlocking time to an earlier date and time. This allows the user, when he feels guilt due to recent overindulgence, to further delay his access to the items within the container, without facing the temptation of an unlocked door.

In another aspect of the device, if the user attempts to lock the container for longer than a user-specified duration, the device can display a Confirm Before Lock prompt giving the lockout duration in days, and wait for affirmative user input before locking. This feature prevents an accidental prolonged lockout.

In another aspect of the device, the user may optionally enable an early open function, called a Cooldown period. When Cooldown is requested, the container will permit one opening only after an unlocking delay time period elapses, and will deny opening after the relocking delay time period elapses. The Cooldown feature allows the user to satisfy an occasional, severe, and long-lasting craving, while allowing time for a short-lived craving to fade.

BRIEF DESCRIPTION OF THE SEVERAL VIEWS OF THE DRAWINGS

A more complete understanding of the present device can be obtained by considering the detailed description in conjunction with the accompanying drawings, in which:

FIG. 6 shows the various status pages shown on the device's display, according to an exemplary embodiment of the device.

DETAILED DESCRIPTION

Figure 1:
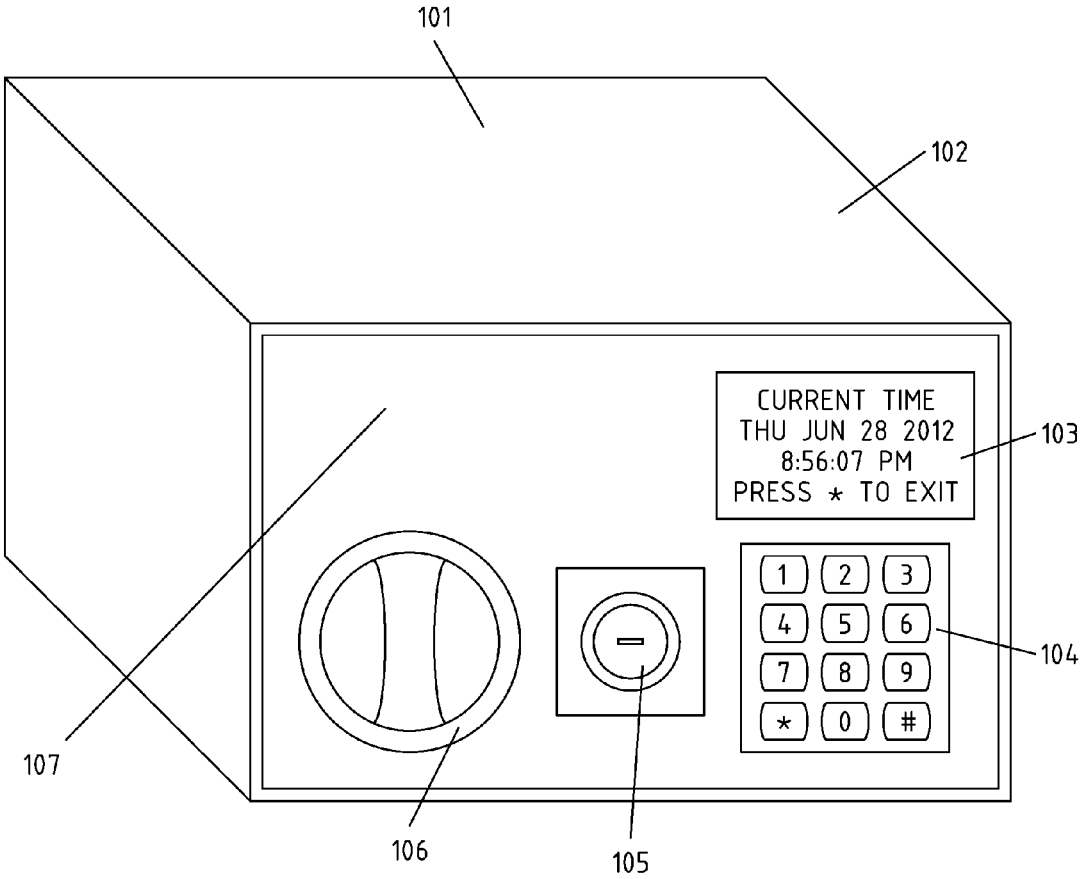
FIG. 1 shows an isometric external view, according to an exemplary embodiment of the device.

An exemplary embodiment 101 is shown in FIG. 1. The container is a metal safe 102 of the type commonly used to store valuables, with a body and a door. The door panel 107 of the safe incorporates a display 103, a keypad 104, a bypass key lock 105, and an opening knob 106. The bypass key lock is shown with its removable cover plate removed.

To open the container, the user presses one of the bottom row buttons (*, 0, or #) on the keypad 104, causing the display 103 to illuminate and display the status of the device. If the device is not time-locked, the display prompts the user to enter a numeric combination access code and press the # key. If the combination entered matches the combination stored in the device's memory, the container permits access by electrically actuating its door releasing solenoid. The user then turns the knob 106 clockwise and pulls to swing the door open.

To close the safe, the user pushes the door closed and turns the knob 106 counter-clockwise to engage the boltwork and internal latch.

Bypass lock 105 is a standard pin tumbler or tubular lock. If the safe's battery is depleted or the user loses the combination, the bypass key may be inserted into the lock 105 and turned, then knob 106 turned to open the safe. Since this safe is intended for self-control purposes, the user should store the key at a remote location or with a trusted third party. The user may also purchase the safe without a key. In this case, a lock number will be provided, so that a matching key can be cut later if one is required.

While the device is unlocked, the user can press a special key combination to set the current time, the unlocking time, and other settings. The user can time lock the safe by pressing the # key.

Figure 2:
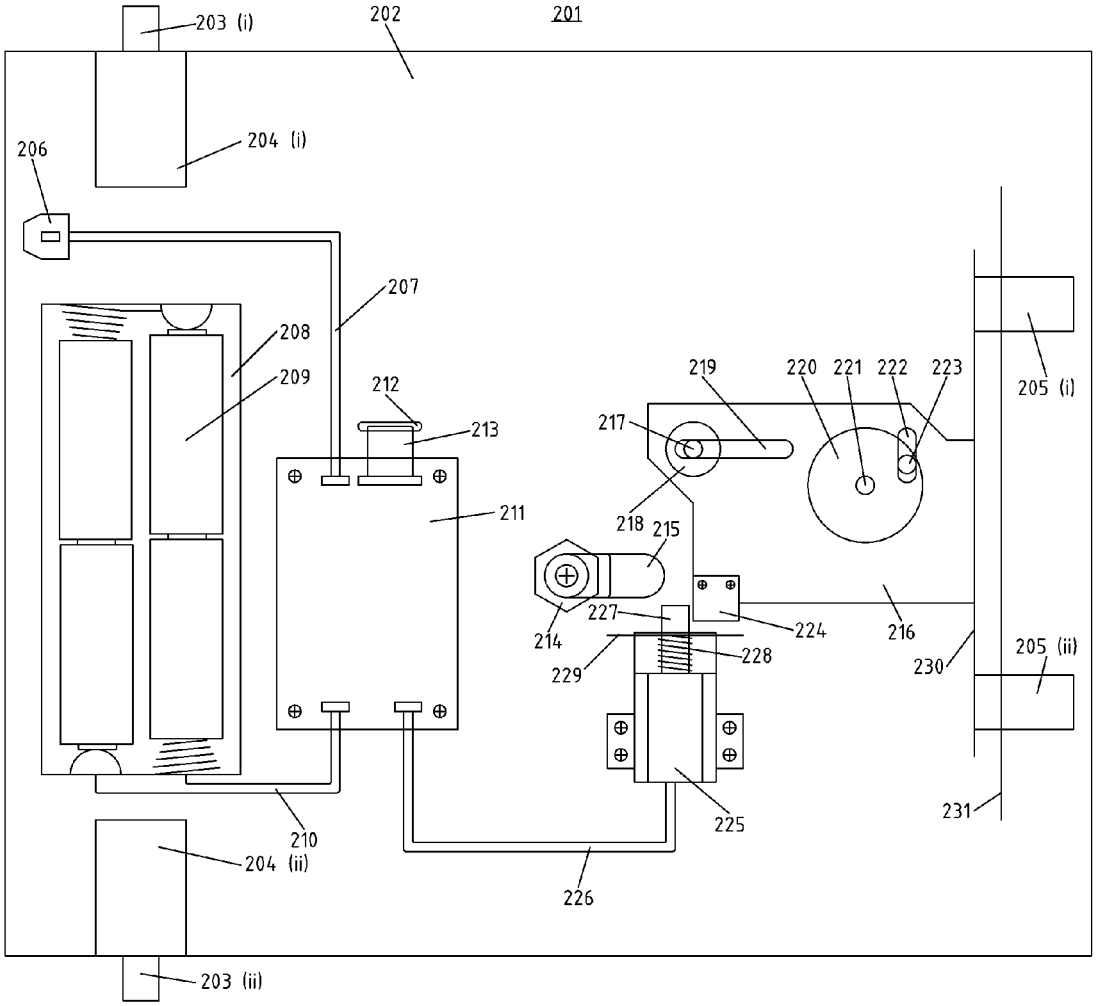
FIG. 2 shows the mechanical and electrical components located on the inside panel of the container door, according to an exemplary embodiment of the device.

FIG. 2 shows the mechanical and electrical components of the exemplary embodiment 201, as seen from the inside of the safe door 202, with its covers removed.

Hinges 204 and hinge pins 203 attach the door to the safe. Bolts 205 are affixed to a movable plate 230, and pass through holes in a fixed plate 231 which is affixed to the safe door 202, so that when the door is closed and the bolts are extended, the door cannot be opened until the bolts are retracted.

Movable plate 230 is affixed at a right angle to sliding plate 216. Pin 217 is affixed to the safe door and passes through notch 219 in plate 216. Washer 218 holds plate 216 parallel to the safe door 202 while leaving it free to slide back and forth, thus moving the bolts.

Shaft 221 extends through a hole in the safe door and attaches to knob 106 on the front of the safe. Wheel 220 is affixed to shaft 221. Notch 222 is cut in plate 216, and pin 223 is affixed to wheel 220. Therefore, turning wheel 220 counter-clockwise (facing FIG. 2) causes plate 216 to move leftward, retracting the bolts 205, while pin 223 moves upward in notch 222. Turning wheel 220 clockwise causes plate 216 to move rightward while pin 223 moves downward in notch 222, engaging the bolts 205.

Figure 3:
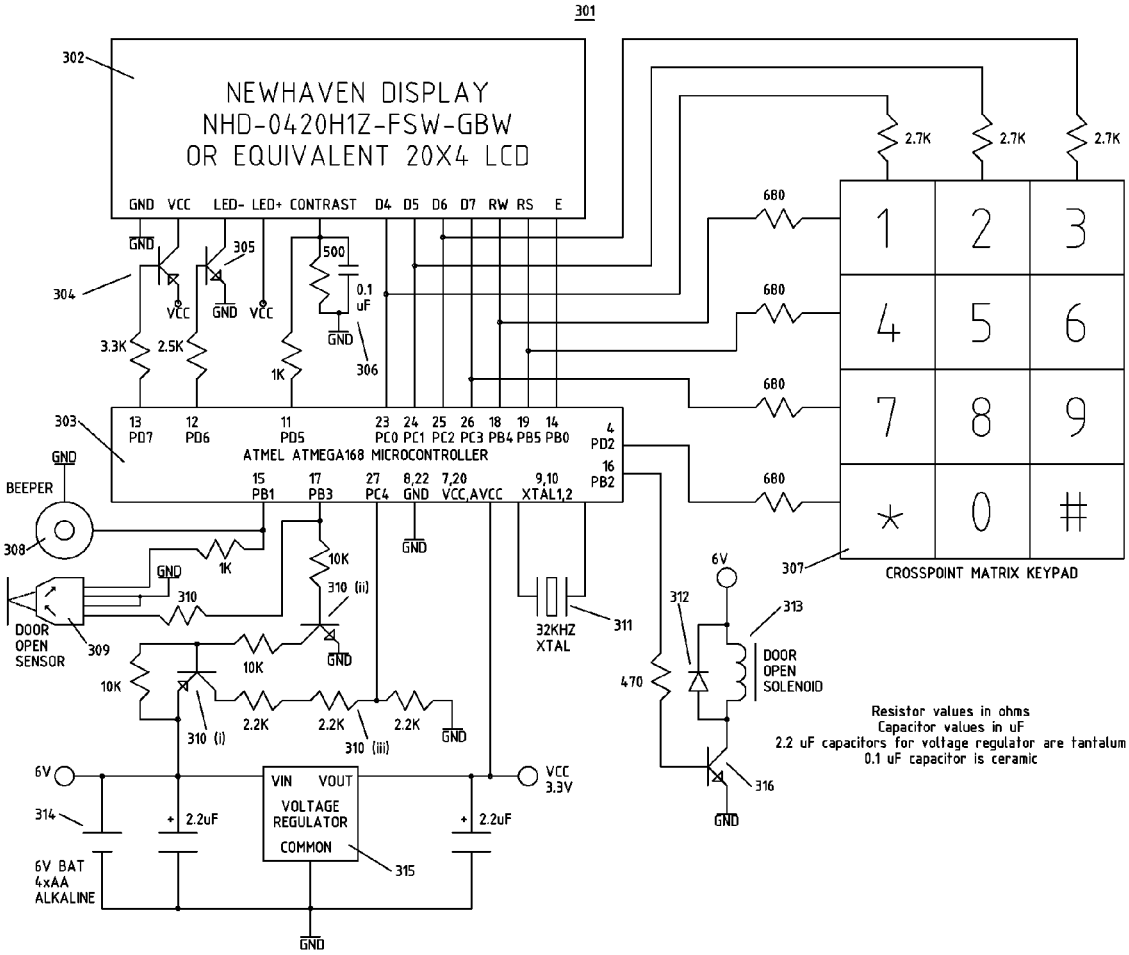
FIG. 3 shows an electrical schematic, according to an exemplary embodiment of the device.

Tab 224 extends downward from plate 216. Electromagnetic solenoid 225 is affixed to the safe door 202. Solenoid 225 has a plunger 227, a return spring 228, and a plate 229. Plate 229 is affixed to the plunger 227. Cable 226 connects solenoid 225 to circuit board 211. Circuit board 211's schematic is shown in FIG. 3. With the bolts extended, when a user turns the knob 106 to attempt to retract the bolts, tab 224 is blocked by plunger 227, preventing plate 216 from moving, and so preventing the bolts from retracting.

When the unlocking criteria are met, circuit board 211 energizes solenoid 225, causing plunger 227 to move downward, compressing spring 228. Tab 224 is no longer blocked, and the user can turn the knob 106 to retract the bolts. When the current to solenoid 225 is turned off, tab 224 holds down plunger 227 until the knob 106 is turned to engage the bolts. Spring 228 then lifts plunger 227, thus blocking tab 224 again and locking the safe.

Bypass lock 105 passes through the safe door 202 and is affixed in place by nut 214. Tab 215 is affixed to the cylinder of the lock. When the user inserts the correct key and rotates the lock cylinder, tab 215 rotates clockwise and presses against plate 229, depressing the plunger 227 and permitting the safe to be opened.

Battery holder 208 contains four AA-type alkaline cells 209 in a series circuit. Cable 210 connects the battery holder 208 to the circuit board 211. Reflective sensor 206 (which may be replaced by a microswitch in an alternate embodiment) is connected to circuit board 211 by cable 207, and senses the open or closed state of the door 202. Ribbon cables 213 pass through a slot 212 cut in the door 202 and connect to the display 103 and keypad 104 on the front of the door 107.

FIG. 3 shows the electrical schematic 301 of the exemplary embodiment. The device is controlled by microcontroller 303, and is powered by four AA-type batteries 314. CMOS voltage regulator 315 provides a constant 3.3 volt supply to the microcontroller.

Alphanumeric display module 302 and matrix keypad 307, mounted on the outside front of the safe door are in communication with the microcontroller 303 to provide the user interface. Ribbon cables 213 connect display 302 and keypad 307 to the circuit board 211 inside the safe.

Transistors 304 and 305, and filter 306 control display 302's power, backlight brightness, and display contrast respectively. Microcontroller 303 scans the buttons of keypad 307 one row at a time. The bottom row of the keypad is connected to an external interrupt line so that a keypress can wake microcontroller 303 from a low-power state. Quartz crystal 311, a standard watch crystal, along with an amplifier built into microcontroller 303, provide a 32,768 Hz oscillator for the timekeeping function. Registers and instructions in the microcontroller count the cycles of the oscillator.

Power switching transistor 316 operates the door releasing solenoid 313. Energizing the solenoid mechanically permits the user to retract the safe's boltwork as explained previously. Diode 312 protects transistor 316 from overvoltage damage at turn-off, which could otherwise occur due to the inductance of solenoid 313.

Reflective optical sensor 309 detects the open/closed state of the safe's door. A microswitch may be used in place of sensor 309. Piezoelectric beeper 308 alerts the user if the safe door is left open when it should be closed. Beeper 308 optionally clicks to confirm each keypress.

Switched voltage divider 310 provides a ⅓ scale sample of the battery voltage to the analog-to-digital converter built into microcontroller 303, so that the microcontroller can detect a low battery condition and alert the user. The battery voltage is measured each time the door releasing solenoid 313 is actuated, and each time the unit is turned on.

Figure 4:
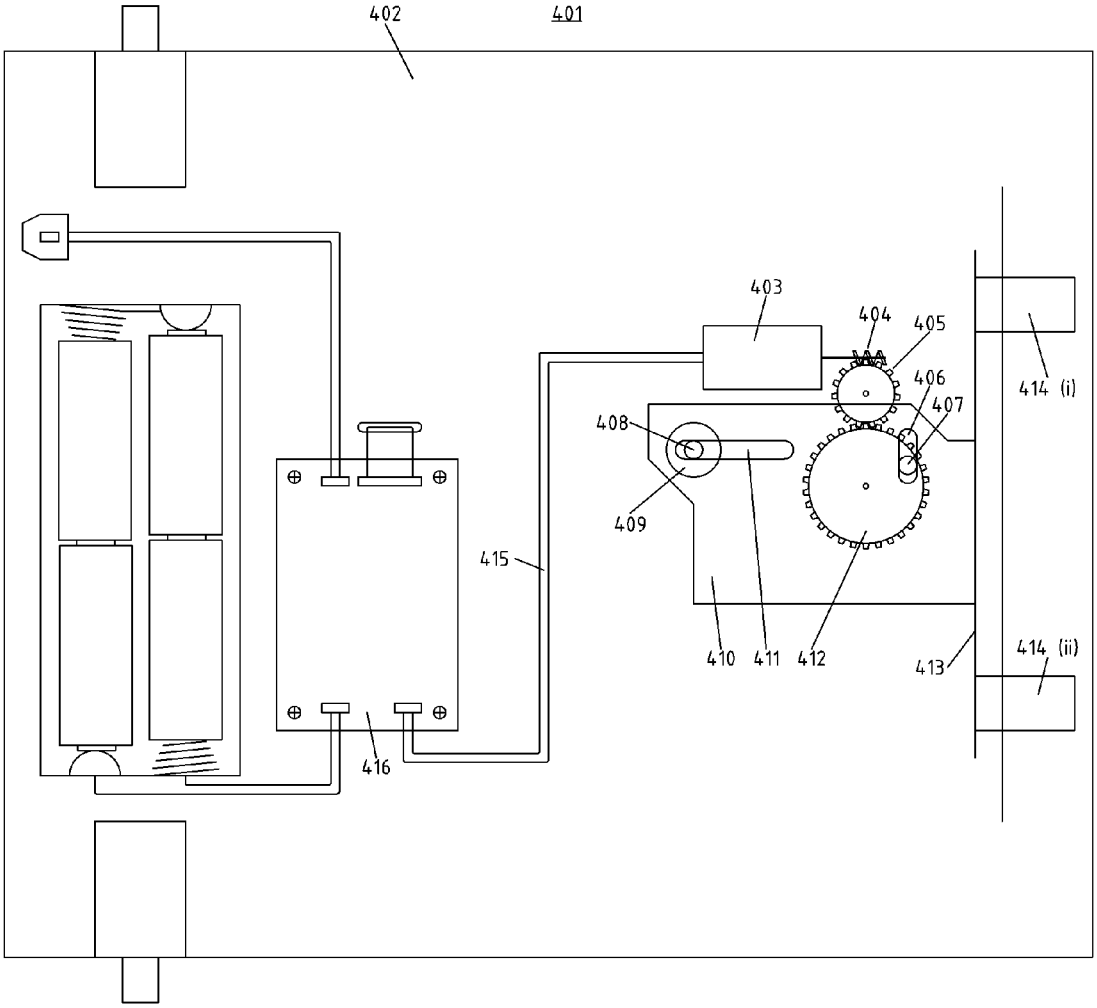
FIG. 4 shows the mechanical and electrical components of an alternative motor-driven unit, according to an exemplary embodiment of the device.

FIG. 4 shows the mechanical and electrical components of an alternative embodiment 401, as seen from the inside of the safe door 402, with its covers removed. FIG. 4 is similar to FIG. 2 except that a motor-driven locking mechanism is shown. The embodiment 401 operates as embodiment 201 except where explained below.

Bolts 414 are affixed to movable plate 413, which is affixed at a right angle to sliding plate 410. Pin 408 is affixed to the door 402 and passes through notch 411 in plate 410. Washer 409 holds plate 410 parallel to the door 402 while leaving it free to slide back and forth, thus moving the bolts.

Gear 412's bearing is affixed to the door 402. Pin 407 is affixed to gear 412 and passes through notch 406 in plate 410. Therefore, when gear 412 is driven clockwise, the bolts 414 are extended. When gear 412 is driven counter-clockwise, the bolts are retracted. This is similar to the operation of the FIG. 2 embodiment except that no shaft passes through the door 402 to the outside.

Gear 405's bearing is affixed to the door 402. Permanent-magnet DC motor 403 is affixed to the safe door 402 and is connected to the printed circuit board 416 by cable 415. Motor 403 has a worm gear 404 affixed to its shaft. Worm gear 404 engages gear 405, and gear 405 engages gear 412. Therefore, when the motor 403 is energized, it will drive the gears 405 and 412, either extending or retracting the locking bolts 414, depending on the polarity of the electric current.

Figure 5:
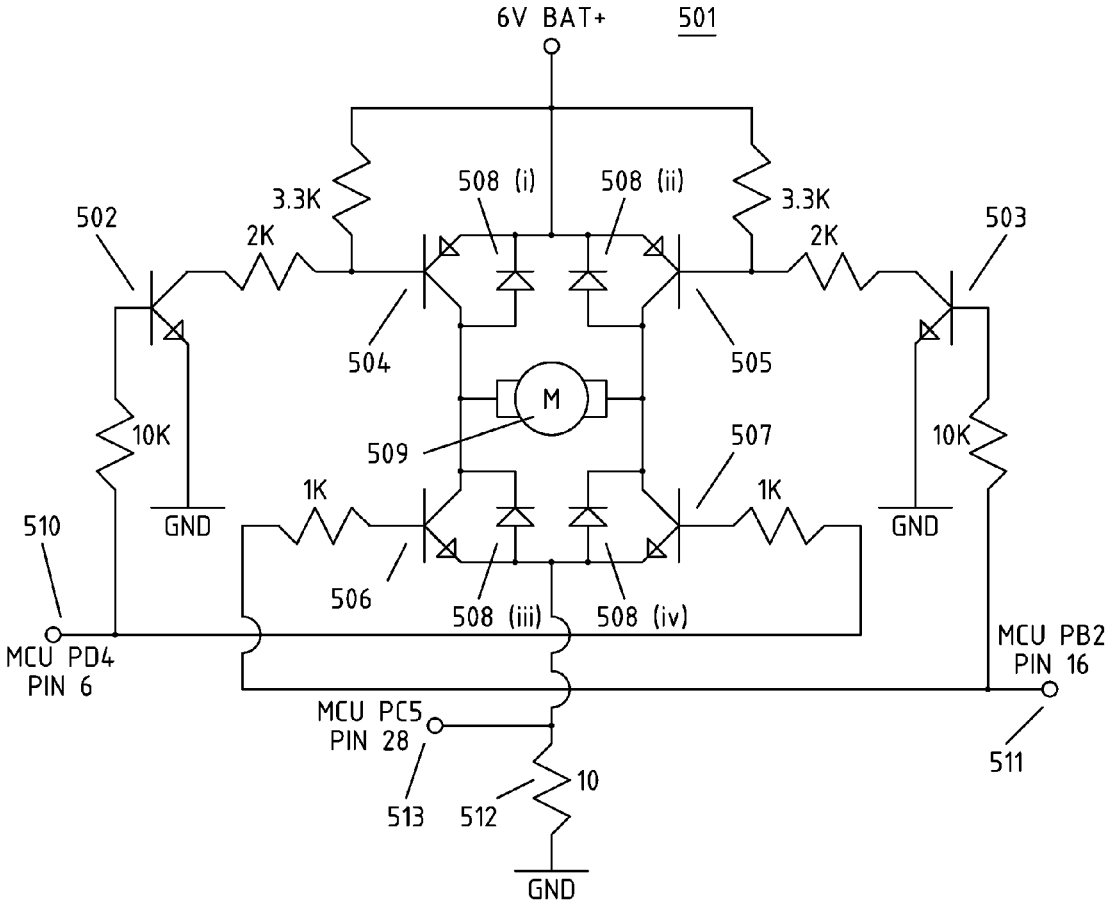
FIG. 5 shows the electrical schematic of the motor drive circuit for the alternative motor-driven unit, according to an exemplary embodiment of the device.

FIG. 5 shows the electrical schematic of an H-Bridge reversing motor driver 501 suitable for the alternative motor-driven lock in FIG. 4. The circuit in FIG. 5 should be added to the circuit in FIG. 3 in place of parts 312, 313, and 316. Inputs 510 and 511 are normally held at logic 0 (0 volts) by the microcontroller 303, therefore, all transistors are non-conducting and no appreciable current is drawn from the battery.

When the microcontroller 303 applies a logic 1 (3.3 volts) to input 510, transistors 502, 504, and 507 conduct, energizing the motor 509 (motor also shown as 403 in FIG. 4) in the locking direction. When the microcontroller 303 applies logic 1 to input 511, transistors 506, 503, and 505 conduct, energizing the motor in the unlocking direction.

Resistor 512 limits motor 509 current and also provides a voltage proportional to motor current 513 to the microcontroller 303. When the motor-driven lock reaches its mechanical stop, the motor will stall and the voltage at point 513 will increase, causing the microcontroller 303 to turn off the motor. Diodes 508 protect transistors 504-507 against inductive transients from the motor.

Resistor values must be adjusted based on the current requirements of the specific motor type. It is important that inputs 510 and 511 are not simultaneously driven with logic 1, as this will cause cross-conduction of the transistors and draw excessive current.

FIG. 6 shows the various status displays 601 of the exemplary embodiment. The user interface is displayed on a 20-character-per-line, 4-line LED-backlit alphanumeric liquid crystal display. The user interface is implemented as a state machine in the microcontroller program, and runs in a separate software thread independent of the time-locking routines in FIG. 8.

Pressing one of the bottom row buttons (*, 0, or #) on the keypad lights the display and shows a series of status displays, changing every 5 seconds by default. The status display sequence changes depending on the state of the device, as explained below.

If the container is unlocked, the Open Time is later than the Current Time, and Auto Relock is not pending, pages 614, 607, 602, and 603 are displayed sequentially.

If the container is unlocked, the Open Time is later than the Current Time, and Auto Relock is pending, pages 608, 614, 607, 602, and 603 are displayed sequentially.

If the container is unlocked and the Open Time has passed, pages 614, 606, 602, 603, and 626 are displayed sequentially.

If the container door is left open, the top line of the display indicates "VAULT DOOR AJAR" as shown in page 617. The beeper 308 will also sound if this feature has been enabled in the setting 705.

If the container is locked, and Cooldown mode is disabled or inactive, pages 612, 602, and 604 are displayed sequentially. If the Cooldown mode is inactive, page 605 is also displayed.

If the container is locked, Cooldown mode is inactive, and the 5* key combination is pressed, page 618 is displayed, then the cycle changes to pages 621, 602, 604, 624, and 612. This sequence continues until the Cooldown is canceled or the Cooldown time arrives.

If Cooldown mode is active and the Cooldown time has arrived, pages 614, 622, 602, 604, and 624 are displayed. The passcode can be entered in this state to open the container.

If the container is opened in Cooldown mode, page 620 is displayed, then two minutes later the sequence 612, 602, 604, 623 is displayed. The Cooldown feature is disabled until the time shown in 623, and the door will not open.

If Cooldown mode is active, and the Cooldown start/cancel (5*) key combination is pressed, page 619 is displayed and the device exits Cooldown mode. The display sequence returns to 612, 602, 604, and 605.

If the container is unlocked or Cooldown unlocked (page 614 is shown) and the user enters the correct passcode and presses #, page 616 is displayed for five seconds, while the unlocking solenoid 313 is energized. If an incorrect passcode is entered, page 615 is displayed and the door does not unlock.

If the Power Off (2*) key combination is pressed, the display turns off and the microcontroller enters low-power mode. This power-down also occurs after one minute of inactivity by default. The state of the user interface is maintained during power-down. The user interface thread is suspended, while the timekeeping interrupt and time-lock thread 801 continue to run once per second.

If the Quick Lock (3*) combination is pressed while the container is unlocked, the device displays the Locking Prompt 609/610 or the visible/audible Locking Countdown 611, and starts the locking process. The Open Time will be set to the Current Time plus one day. Quick Lock has no effect while the container is locked.

If the Skip Next Open Time (4*) key combination is pressed, the device displays page 625, with a new open time based on the Repeat setting, or defaulting to one day forward. If the user presses #, the Open Time is updated. If the user presses *, the Open Time is not changed. Either way, the device then returns to its normal display sequence.

Figure 7:
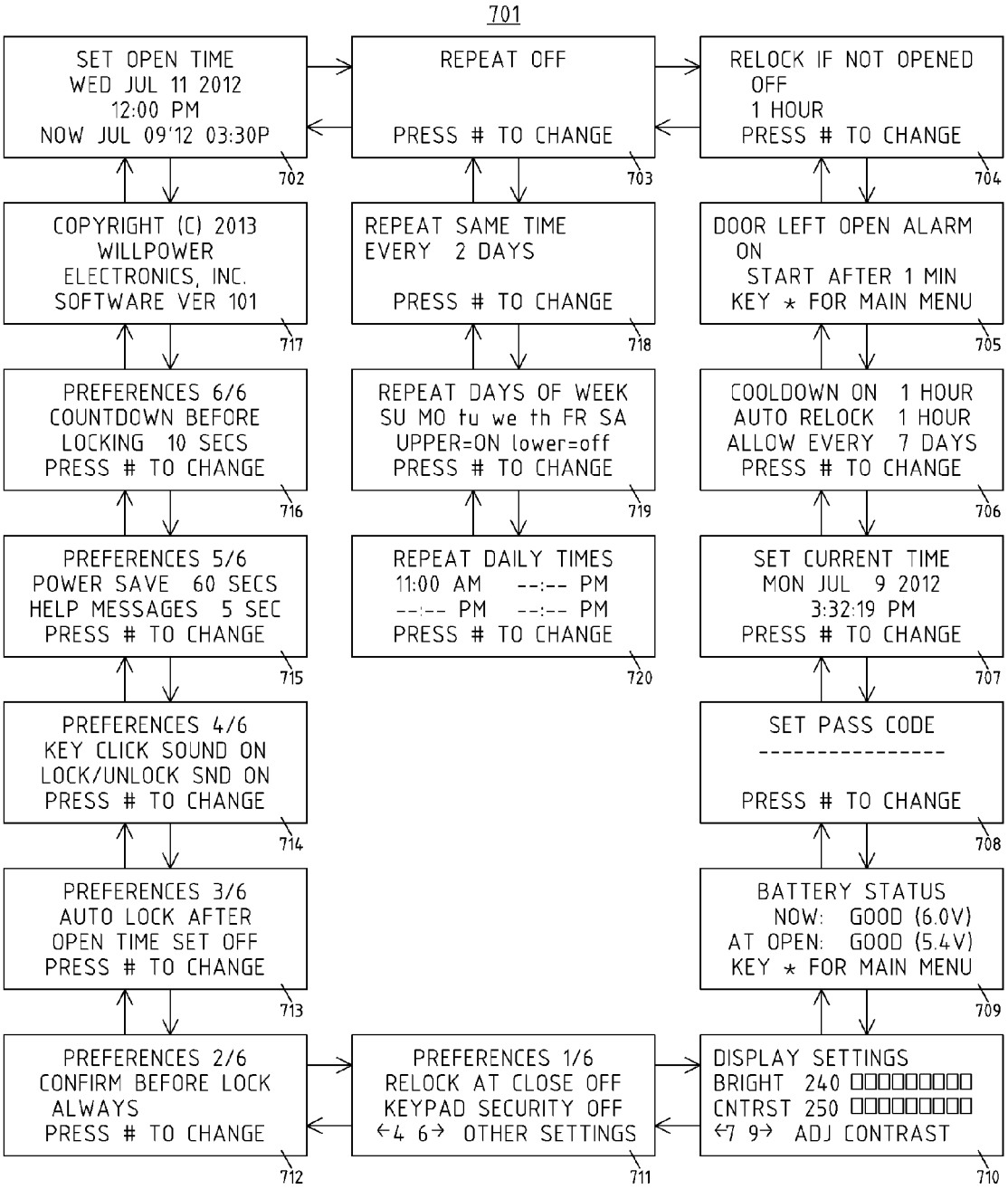
FIG. 7 shows the various configuration pages used to set up the unit, according to an exemplary embodiment of the device.

FIG. 7 shows the various configuration pages 701 of the exemplary embodiment. If the user presses the Settings (1*) key combination from the status display, and the Current Time has already been set, page 702 will be displayed. If the Current Time has not been set, page 707 will be displayed to prompt the user to set the Current Time. Page 707 is also displayed when the batteries are installed or replaced.

If the user presses * (LOCK VAULT) from the status display, and the Open Time is earlier than the Current Time, page 702 will be displayed to prompt the user to set the Open Time.

When one of the configuration pages is displayed, the user can press 4 to move counter-clockwise, or 6 to move clockwise, through the full loop of configuration pages. For example, from page 703, the 6 key moves to page 704 and the 4 key moves to page 702. The user can press * to exit to the Status Display. The user can press # to change the settings on the currently displayed configuration page.

Page 702 is used to set the Open Time. When the user presses #, the Month is first highlighted. If the date was in the past, it is changed to the current date. The user must select the month, then press #, enter the day, press #, enter the year, press #, enter the hour, press #, enter the minute, press #, choose AM/PM using 4 and 6 to select, then press # to save. When the date is changed, the day of week updates automatically. The screen's bottom line displays a rotating series of prompts that show the user all his available options. Pressing * at any time cancels the setting process. If the container is locked, the user can change the Open Time to a later time (delaying opening) but cannot change to an earlier opening time.

The user may set a schedule of unlocking times with the Repeat Times feature. Pages 703, 718, 719, and 720 are used to set the Repeat Times. The user can select one of these four modes, and all but Off (page 703) have further settings. If the Repeat Times mode is set to Off, the Open Time does not automatically update. If the Repeat Times mode is set to any of the other three options, 718, 719, or 720, the Open Time is automatically updated at each unlocking. The options cannot be changed while the device is time locked.

Page 718 causes the Open Time to be advanced to the same time every day or every N days, where the user can enter the number of days. In the figure, it is set to open every other day (displayed as "EVERY 2 DAYS".)

Page 719 causes the Open Time to be advanced to the same time each day, while skipping deselected days of the week. For example, if Monday, Wednesday, and Friday are selected, the device will unlock at the specified Open Time on each of those days, and will not unlock on other days of the week.

Page 720 allows the user to enter up to eight times of day. There are two pages of four times each, and the times are automatically sorted when the user makes changes. Duplicate times are automatically discarded. The Open Time will advance, at each unlocking, to the next specified time. If the Current Time is later than the last specified time, the Open Time will advance to the first scheduled time on the next day.

If Page 704 is enabled, and the container door is not opened after the Open Time arrives, the device will automatically relock until the next Open Time as determined by the Repeat settings. The user can set the relock delay in hours or minutes. When the relocking time arrives, the device will perform a visible countdown, with an optional tick-tock sound, giving the user an opportunity to cancel the relocking.

Page 705 enables an alarm to remind the user to close the container door. If this feature is enabled, the device will wait the set number of minutes and then beep until the door is closed. The beep will increase in intensity after one minute.

Page 706 configures the Cooldown mode. The Cooldown mode can be enabled or disabled. If enabled, there are three settings: unlocking delay time period, relocking delay time period, and inhibit delay time period. The unlocking delay time period determines the time between a Cooldown request (5* key sequence) and the container permitting access. The relocking delay time period determines how long the device remains in Cooldown unlocked mode before automatically relocking. The inhibit delay time period determines how often a Cooldown open is permitted.

If the user opens the door during the Cooldown unlock period, the device relocks immediately when the door is closed, does not permit another Cooldown unlock until the inhibit delay has passed, and displays page 623 in the meantime. If the user does not open the door, and the device relocks automatically, the Cooldown can be requested again immediately.

Page 707 is used to set the Current Time. This page can be selected manually, and is also displayed automatically when batteries are installed.

Page 708 is used to set the passcode for opening the container door. The door must be open to change the passcode. The user is prompted for a new passcode, and then prompted to re-enter it to confirm. The passcode is also used to unlock the keypad when the Keypad Security feature (page 711) is enabled.

Page 709 shows the battery voltage and status (GOOD, FAIR, LOW.) When the batteries are low, this page is displayed automatically, and the container will not time lock. The microcontroller retains and displays the lowest voltage measured during opening, as well as the present voltage.

Page 710 adjusts the display brightness and contrast. Pressing the 1 and 3 keys adjusts the backlight brightness; pressing the 7 and 9 keys adjusts the contrast.

Page 711 controls two options. If Relock At Close is enabled, the container door is closed after being opened, and the Open Time is later than the Current Time, the device will automatically begin the visible/audible Locking Countdown 611. The container will lock when the count reaches zero, unless the user presses a key to abort.

The container's user interface can be secured. If this option is enabled, the passcode must be entered at each power-up before any operations can be carried out. This prevents unauthorized persons from tampering with or time-locking the container. If Keypad Security is enabled, all keypad functions are disabled at every power-up until the user enters the passcode and presses #. Page 613 is displayed while the keypad is disabled.

Page 712 sets the Confirm Before Lock prompt option. If this is set to Always, page 609 or 610 is always displayed when locking, and the user must press # to proceed. If set to a number, the confirmation is displayed only if the container is being locked for that number of days or longer. This feature prevents an accidental prolonged lockout.

Page 713 determines whether the device automatically begins the locking process after the user finishes setting the Open Time on page 702. If 713 is set to On, page 609, 610, or 611 appears after setting the Open Time. If 713 is set to Off, page 702 remains after setting the Open Time.

Page 714 controls two sound-related options. If the Key Click Sound option is set to On, the beeper 308 emits a short click at each keypress. If the Key Click Sound option is set to Off, no click is produced.

If the Lock/Unlock Sound option is set to On, the beeper 308 produces a "tick-tock" sound (alternating high and low frequency clicks) during the page 611 countdown. It also produces a locking tone (three tones rising in frequency) when the container time locks, and an unlocking tone (three tones falling in frequency) when the container unlocks. If the Lock/Unlock sound option is set to Off, these sounds are not produced.

Page 715 controls two user interface options. The Power Save time determines how long the screen remains illuminated with no user input. When the corresponding number of seconds have passed, the screen turns off to save power, and the microcontroller goes into low power mode. Pressing one of the bottom row keys (*, 0, or #) will turn the display back on, leaving the user interface in the same state as before the display timed out.

The Help Messages setting determines how quickly the screen cycles through messages. This controls the speed of the main menu status pages in FIG. 6, as well as the help messages displayed on the bottom line of the settings pages in FIG. 7.

Page 716 sets the duration in seconds of the Locking Countdown on page 611.

Page 717 shows the software copyright notice, software version, and unit serial number. This page alternates between the software copyright notice and software version (shown) and serial number (not shown). There are no settings to be changed on this page.

With the exception of the Open Time and Current Time values, all the FIG. 7 settings are retained in the EEPROM memory of the microcontroller 303 while the batteries are removed.

Figure 8:
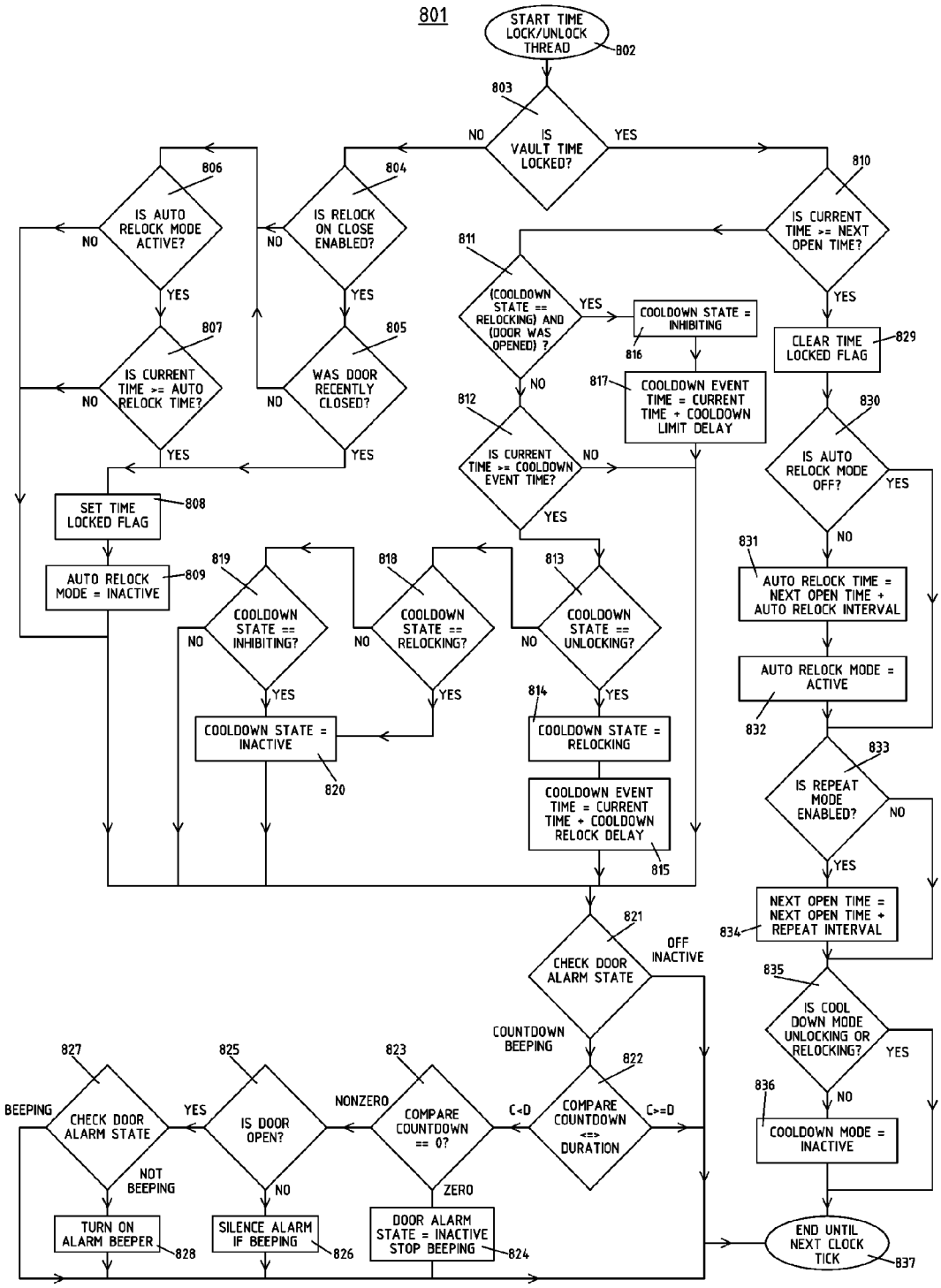
FIG. 8 shows the flowchart of the system, according to an exemplary embodiment of the device.

FIG. 8 shows the flowchart 801 of the exemplary device's time-locking and alarm logic. This procedure should run multiple times per minute, and the exemplary embodiment runs it once per second. The procedure starts at entry point 802 and first branches at state 803 based on whether the container is time-locked.

If the container is time-locked, branch 810 checks whether the Open Time has arrived. If the Open Time has arrived, action 829 clears the time lock flag. Branch 830 checks the Auto Relock state, and if Auto Relock is enabled, sets the Auto Relock time at action 831, and sets the Auto Relock state to active at action 832.

Next, branch 833 checks the Repeat Time mode and setting, and if enabled, updates the Open Time at action 834 according to the Repeat Time mode and setting. Finally, branch 835 checks the Cooldown state, and if it was previously Unlocking or Relocking, action 836 sets it back to Inactive. The routine ends at endpoint 837.

If the device is time-locked at branch 803 and the Open Time has not arrived (branch 810), the program proceeds to branch 811 for the specific case where the container door was opened during Cooldown Relocking mode. If the container was opened during Cooldown, the state is set to Inhibiting (action 816), the Cooldown event time is updated at action 817, the program proceeds to the Door Alarm check 821, and the user interface thread presents page 620.

If the branch 811 condition is false, then branch 812 checks to see if the Cooldown event time has been reached. If the Cooldown event time has been reached, branch 813 checks the Cooldown state. In the Unlocking state, the Cooldown state changes to Relocking at action 814, and action 815 sets the Cooldown event time. In the Relocking state 818 or Inhibiting state 819, the state is changed to Inactive at action 820. The user interface thread, in response to the 5* Cooldown open request 605, sets the Cooldown event time to the Current Time plus the Cooldown unlocking delay, and sets the Cooldown state to Unlocking, thus starting the Cooldown process.

If the device is not time-locked at branch 803, the software checks the Relock on Close state at branch 804 and the door recently closed flag at branch 805. If both are true, the container is time-locked at action 808 and the Auto Relock mode is set to Inactive at action 809. The user interface thread will present page 611.

If the Relock on Close is not executed, the software checks the Auto Relock mode at branch 806 and Auto Relock time at branch 807. If the Auto Relock mode is active and the Auto Relock time has arrived, execution proceeds to actions 808 and 809 as above.

Branch 821 checks the Door Alarm state. The user interface thread starts the beeper countdown when the door is opened. The initial value of the beeper countdown is the value in page 705, converted to seconds, plus a 300 second maximum beeping duration. Therefore, a one-minute Door Alarm setting would start this value at 360. The counter is decremented once per second.

If the Door Alarm state is off or inactive, execution ends at endpoint 837. If the Door Alarm state is Countdown or Beeping, branch 822 compares the Countdown time with the fixed beeping duration of 300 seconds. If the Countdown is less than the duration, the beeper 308 will sound until the Countdown reaches 0. This limits beeping to 5 minutes.

Branch 823 checks the countdown, and if it is zero, the beeper 308 is silenced at action 824. Branch 825 checks the door state, and if the door is closed, the beeper is silenced at action 826. Branch 827 checks the beeper state, and if not beeping, the beeper is turned on at action 828. This causes the beeper to sound if the door is open, the countdown is below the duration, and the countdown is not zero.

Figure 9:
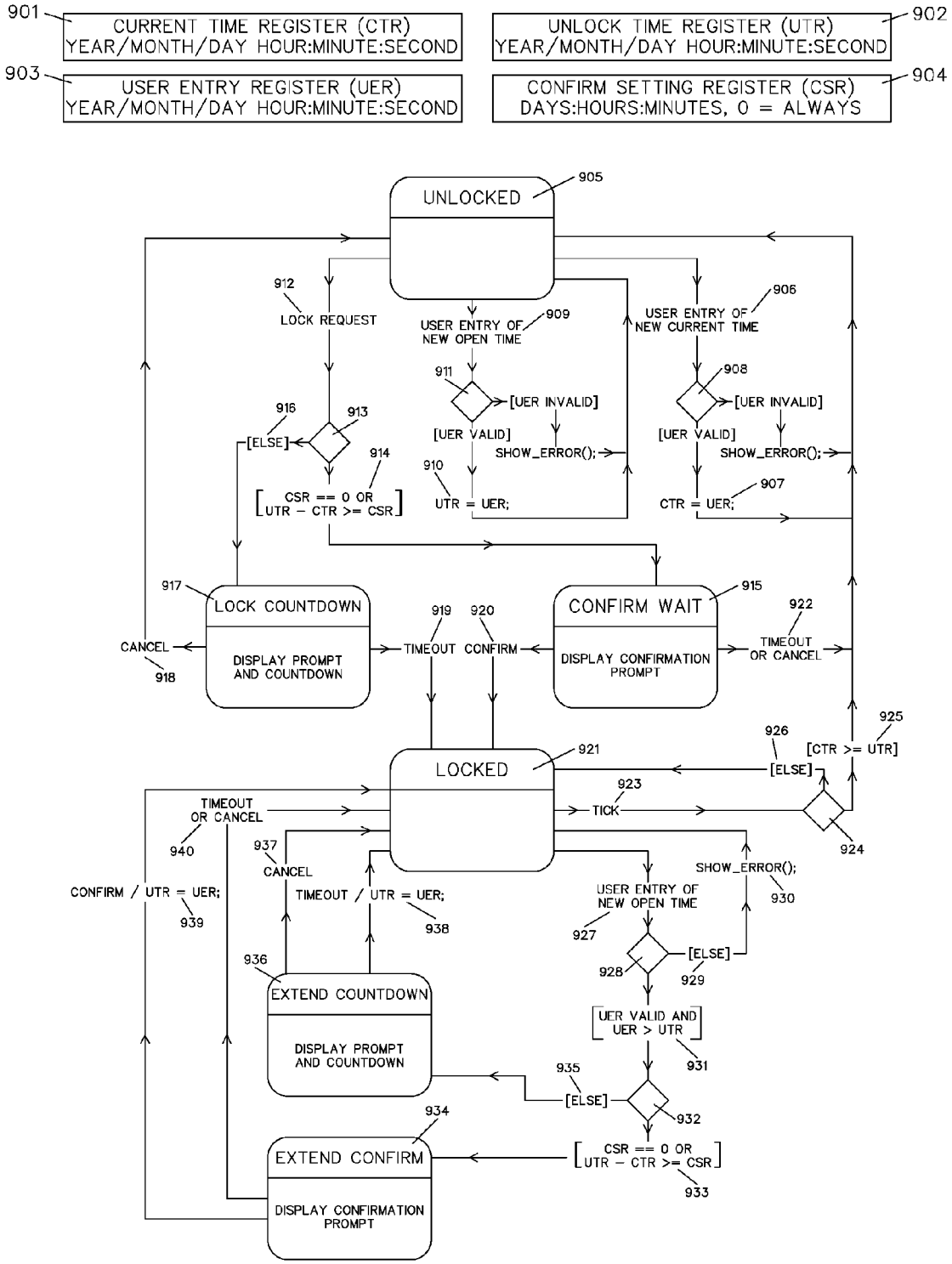
FIG. 9. shows a UML-style extended state machine diagram of the Extend While Locked function, according to an exemplary embodiment of the device.

FIG. 9 is a UML-style extended state machine diagram of the Extend While Locked function, as implemented in an exemplary embodiment of the device. An extended state machine includes registers, assignment statements, and conditional tests as well as state transitions. The exemplary machine has six states and four registers.

The Current Time Register (CTR) 901 stores the year, month, day, hour, minute, and second. It is incremented once per second by an interrupt handler which is outside this state machine, so it will always contain the current time. The Current Time can be set 707 only when the state machine is in the Unlocked state 905.

The Unlock Time Register (UTR) 902 stores the unlocking date and time, in the same format as the Current Time Register.

The User Entry Register (UER) 903 receives the date/time value entered by the user when he is prompted to enter such a value.

The Confirm Setting Register (CSR) 904 contains the minimum locking time (days, hours, minutes) which requires a user confirmation before locking. The user can set 712 this value, and as a special case, a value of 0 means that confirmation is always required.

The machine has six states. In the Unlocked state 905, the door can be opened, and the UTR 902 can be freely set. In the Locked state 921, the UTR can be set only to a time later than its current setting, and the door cannot be opened. The states Confirm Wait 915, Lock Countdown 917, Extend Confirm 934, and Extend Countdown 936, are transient states during which the user is prompted to confirm an action, and during which the door cannot be opened.

At power-up, the machine starts in the Unlocked state 905. In the Unlocked state 905 only, the user can set the current date/time 906, which will be saved 907 to the CTR 901 if it is a valid date/time 908.

In the Unlocked state 905, the user can freely set the Unlock date/time 909. It will be accepted and saved 910 if it is a valid date/time 911.

In the Unlocked state 905, the user can enter a Lock request 912. Branch 913 computes, using date/time arithmetic, the interval between UTR 902 and CTR 901, and compares it with the interval in CSR 904. If CSR is 0, or if the interval is greater than or equal to CSR, the state machine transitions 914 to the Confirm Wait state 915. If neither of these conditions is true 916, the state machine transitions to the Lock Countdown state 917.

The Lock Countdown state 917 and the Confirm Wait state 915 are similar in that each displays the proposed locking date/time (UTR 902) and waits for user confirmation or cancellation. The difference is that the Lock Countdown state 917 displays a countdown, and if the user does not cancel 918 during the countdown, automatically proceeds 919 to the Locked state 921. The countdown period defaults to 10 seconds, and can be changed 716 by the user. On the other hand, the Confirm Wait state 915 displays the duration of the proposed locking in days 610, and proceeds 920 to the Locked state 921 only upon user confirmation; it does not proceed there automatically. Upon timeout or cancellation 922, it returns to the Unlocked state 905.

In the Locked state 921, the once-per second TICK event 923, generated by a hardware interrupt external to this state machine, compares 924 the CTR 901 with the UTR 902. If the CTR is later than or equal 925 to the UTR, the machine returns to the Unlocked state 905; otherwise the machine remains 926 in the Locked state 921. In this way, the container unlocks when the unlocking time arrives. Visible or audible notification may be provided to the user when the container unlocks.

In the Locked state 921, the user can enter 927 a new unlocking time into the UER 903. The machine compares 928 the UER with the UTR 902. If the user entry is not later 929 than the current unlocking time, the setting attempt is immediately rejected with an error message 930, while the container remains locked. This test ensures the duration of locking can be lengthened, but not shortened, while the container is locked.

If the new unlocking time (UER) 903 is later 931 than UTR 902, branch 932 computes, using date/time arithmetic, the interval between UTR and CTR 901, and compares it with the interval in CSR 904. If CSR is 0, or if the interval is greater than or equal to CSR, the state machine transitions 933 to the Extend Confirm state 934. If neither of these conditions is true 935, the state machine transitions to the Extend Countdown state 936.

The Extend Countdown state 936 and the Extend Confirm state 934 are similar in that each displays the proposed new unlocking date/time (UER 903) and waits for user confirmation or cancellation. The difference is that the Extend Countdown state 936 displays a countdown, and if the user does not cancel 937 during the countdown, automatically proceeds 938 to copy the UER 903 into the UTR 902, thus changing the unlocking time. The countdown period defaults to 10 seconds, and can be changed 716 by the user. On the other hand, the Extend Confirm state 934 displays the duration of the proposed locking in days, and proceeds 939 to copy the UER into the UTR only upon user confirmation; it does not proceed there automatically. Upon timeout or cancellation 940, it takes no action and keeps the current unlocking time.

Based on the principle that the user of a self-limiting locking container should be empowered to make his best decisions during moments of strength, while avoiding temptation during moments of weakness, the Extend While Locked function has advantages for the self-control user that are not relevant to a security device such as a bank vault.

Even while experiencing guilt over the recent overuse of objects or substances, a self-control user may realize that once his self-limiting container unlocks, he will unwisely indulge again.

The Extend While Locked feature permits that user to make the wise decision to lengthen his wait time before the container unlocks, in an effort to make up for his overindulgence. Moreover, it permits him to make this decision while the container is still locked, without facing the temptation of an unlocked door.

Finally, the Confirm Before Lock feature protects the user from an accidental prolonged lockout, so he can rest assured that he will not mistakenly set the locking container's open time to a date and time prohibitively far in the future.

CONCLUSION

The foregoing Detailed Description has disclosed, to those experienced in the relevant fields of electrical engineering, embedded software development, and mechanical engineering, how to make and use a time-locked container specifically optimized for self-control purposes, and has further disclosed the best methods currently known to the inventors for implementing such a container, including the electrical and user-interface aspects of the design. However, it will be immediately apparent to those skilled in the technology, that a precommitment container could be implemented in many other ways. For example, the display could show animated clock hands instead of a digital clock; a different microcontroller architecture could be used; different types of containers could be used; and one or more dials could be used in place of a keypad as the input device.

For all of the foregoing reasons, the Detailed Description is to be regarded as being in all respects exemplary and not restrictive, and the breadth of the device and method disclosed herein is to be determined not from the Detailed Description, but rather from the claims, as interpreted with the full breadth permitted by the patent laws.

What is claimed is:

1. A device to enable a user to self-limit access to one or more objects or substances, comprising:

(a) a container, (b) a door that denies access to the interior of said container when said door is closed, (c) a door locking means, which prevents said door from opening once said door has been closed, (d) a door releasing means, which permits said door to open upon receipt of an electrical signal, (e) an oscillator means suitable for timekeeping, (f) a control means, having an electronic memory capable of storing a plurality of date and time of day values, having counter means to count the cycles of said timekeeping oscillator, and having power switching means to trigger said door releasing means, (g) a display means, receiving input from said control means, which is visible to the user while said door is closed, (h) a user input means, providing input to said control means, which is accessible to the user while said door is closed, (i) said control means containing instructions to:

accept, from said user input means, a current date and time of day, while said control means is in an unlocked state, store said current date and time of day in said electronic memory, count the cycles of said oscillator, and continuously update said current date and time of day values stored in said electronic memory, accept a desired opening date and time of day, while said control means is in said unlocked state, store said desired opening date and time of day in said electronic memory, accept a command to place said control means into a locked state, compare said current date and time of day with said desired opening date and time of day stored in said electronic memory, place said control means into said unlocked state, when said current date and time of day equals said desired opening date and time of day, accept, while said control means is in said locked state, a new desired opening date and time of day, compare, while said control means is in said locked state, said new desired opening date and time of day with said desired opening date and time of day, replace said desired opening date and time of day with said new desired opening date and time of day, while said control means is in said locked state, when said new desired opening date and time of day is later than said desired opening date and time of day, reject and discard said new desired opening date and time of day, while said control means is in said locked state, when said desired opening date and time of day is later than said new desired opening date and time of day, activate said power switching means to trigger said door releasing means, in response to a command to permit said door to open, while said control means is in said unlocked state, refuse a command to permit said door to open, while said control means is in said locked state, refuse a command to adjust said current date and time of day, while said control means is in said locked state, whereby the user may self-limit his access to one or more objects or substances until said desired opening date and time of day, and whereby he may extend said desired opening date and time of day while said control means is in said locked state.

2. A method of self-limiting the frequency and quantity of use of objects and substances, comprising a user:

(a) placing objects or substances, which are subject to compulsive overuse, into a container which is equipped with an electrically controlled locking mechanism and a control means to implement a time lock and to permit the extension of the locking period while said container is time locked, (b) closing the door of said container, (c) setting a current date and time of day, (d) setting an unlocking date and time of day to permit access to said container, (e) entering a command to place said control means into a locked state, (f) setting a later unlocking date and time of day, while said control means is in said locked state, prior to the occurrence of said unlocking date and time of day, (g) waiting for said later unlocking date and time of day to arrive, (h) entering a command to permit said container door to open, (i) opening said container door, removing and using some of the contents of said container, returning the remaining contents to said container, and closing said container door.

3. The device of claim 1, wherein said control means contains additional instructions to inform the user, before time locking said container, of a computed duration of locking, and to permit the user to abort the locking process, comprising said control means containing additional instructions to:

(a) subtract, using date and time arithmetic, said current date and time of day from said desired opening date and time of day, to produce said computed duration of locking, (b) display said computed duration of locking on said display means, (c) start a locking delay timer for a predetermined number of seconds, (d) abort the locking process, upon receiving a user cancellation via said input means, (e) enter said locked state, upon the expiration of said locking delay timer, without receiving said user cancellation.

4. The device of claim 3, wherein said control means contains additional instructions to require affirmative user input to continue the locking process, if and only if said computed duration of locking will exceed a predetermined period of time, comprising said control means containing additional instructions to:

(a) accept, and store in electronic memory, a minimum duration requiring confirmation from the user, (b) start said locking delay timer, without pausing for confirmation from the user, when said minimum duration requiring confirmation exceeds said computed duration of locking, (c) display a prompt on said display means and pause for user input, when said computed duration of locking equals or exceeds said minimum duration requiring confirmation, (d) start said locking delay timer, upon receiving a user confirmation via said input means, (e) abort the locking process, upon receiving a user cancellation via said input means.

* * * * *